US006045337A

United States Patent [19]

Tokumasu

[11] Patent Number: 6,045,337

[45] Date of Patent: Apr. 4, 2000

[54] CLUTCHLESS VARIABLE CAPACITY SWASH PLATE COMPRESSOR

[75] Inventor: Hiroshi Tokumasu, Higashimatsuyama, Japan

[73] Assignee: Zexel Corporation, Tokyo, Japan

[21] Appl. No.: 09/081,506

[22] Filed: May 20, 1998

[30] Foreign Application Priority Data

May 26, 1997 [JP] Japan ..... 9-151658

[51] Int. Cl.[7] ..... F04B 1/26

[52] U.S. Cl. ..... 417/213; 417/222.2; 417/270

[58] Field of Search ..... 417/213, 222.1, 417/222.2, 270, 295

[56] References Cited

U.S. PATENT DOCUMENTS

| | | | |
|---|---|---|---|
| 4,723,891 | 2/1988 | Takenaka et al. | 417/270 |
| 4,730,986 | 3/1988 | Kayukawa et al. | 417/270 |
| 5,577,894 | 11/1996 | Kawaguchi et al. | 417/222.2 |
| 5,785,502 | 7/1998 | Ota et al. | 417/270 |

FOREIGN PATENT DOCUMENTS 7-286581 10/1995 Japan .

*Primary Examiner*—Charles G. Freay

*Attorney, Agent, or Firm*—Frishauf, Holtz, Goodman, Langer & Chick, P.C.

[57] ABSTRACT

There is provided a clutchless variable capacity swash plate compressor. A valve element is arranged at an intermediate portion of a refrigerant inlet passage, for increasing and decreasing an opening area of the intermediate portion. An urging member urges the valve element in a direction of a large valve opening position in which the opening area is large. An accumulator accumulates the high-pressure refrigerant gas therein to build up pressure for urging the valve element in a direction of a small valve opening position in which the opening area is small. When suction pressure of the suction refrigerant gas is high, a pilot valve closes to inhibit the supply of a high-pressure refrigerant to the accumulator to thereby bring the valve element to the large valve opening position, whereas when the suction pressure is low, the pilot valve opens to permit the supply of the high-pressure gas to the accumulator to bring the valve element to the small valve opening position. A selector valve operates to select a first valve position for establishing communication between the suction port and the crankcase when the valve element is in the large valve opening position, and a second valve position for establishing communication between the suction chamber and the accumulator when the valve element is in the small valve opening position.

11 Claims, 3 Drawing Sheets

CLUTCHLESS VARIABLE CAPACITY SWASH PLATE COMPRESSOR

BACKGROUND OF THE INVENTION

1. Field of the Invention

This invention relates to a clutchless variable capacity swash plate compressor, and more particularly to clutchless variable capacity swash plate compressor to which torque of an engine is constantly transmitted.

2. Description of the Prior Art

Conventional clutchless compressors include a clutchless variable capacity awash plate compressor. In this compressor, the inclination angle of a swash plate varies with suction pressure to change the stroke length of each piston, whereby delivery quantity or capacity of the compressor is increased or decreased.

However, when a clutchless variable capacity awash plate compressor in which the minimum delivery quantity or capacity thereof is not equal to zero is employed as a clutchless compressor, an evaporator supplied with compressed refrigerant gas from the compressor has its surface frosted by being cooled by evaporation of the refrigerant gas when the compressor is under a low thermal load condition. As a result, it often happens that the evaporator is frozen, and ventilation is hindered, which results in degradation of cooling capability of the compressor.

To eliminate this inconvenience, there was proposed a method in which when thermal load on the compressor decreases (equivalent to a state of a clutch-type compressor in which a clutch therefor is disengaged), refrigerant gas is circulated within the compressor to thereby reduce the amount of refrigerant gas discharged from the compressor to zero (Japanese Laid-Open Patent Publication (Kokai) No. 7-286581).

However, this clutchless compressor uses a sleeve for closing a low-pressure side thereof, which is axially slidably fitted on a drive shaft. This sleeve, however, forms assembly with a bearing supporting the drive shaft, which prevents the drive shaft from being sufficiently preloaded. As a result, a lug plate fixedly fitted on the drive shaft for transmitting torque of the drive shaft to a swash plate becomes axially unstable, which causes the lug plate to vibrate, generating loud untoward noises. Especially when the compressor is in a high-load condition, in which the delivery quantity is large, the noises become louder since a spring for retaining the sleeve is expanded to decrease the preload applied to the drive shaft.

If the spring for retaining the sleeve is set to have an increased urging force, a load applied to a thrust bearing under a minimum delivery condition of the compressor is increased, and larger torque is required of the drive shaft. As a result, the power consumption is increased in the minimum delivery condition equivalent to the clutch-disengaged state of the clutch-type compressor. Therefore, an increase the urging force of the retaining spring cannot be a solution to the above problem.

Further, the bearing supporting the drive shaft abuts a cylinder block of the compressor via the sleeve. This produces a radial gap between the sleeve and the cylinder block, causing louder noises.

Moreover, components of the clutchless compressor including the cylinder block are complicated in construction. This makes it difficult to share component parts with a clutch-type variable capacity swash plate compressor.

SUMMARY OF THE INVENTION

It is an object of the invention to provide a clutchless variable capacity swash plate compressor which is capable of circulating refrigerant gas within the compressor without generating untoward noises, to thereby reduce the amount of refrigerant gas discharged from the compressor to zero.

To attain the above object, the present invention provides a clutchless variable capacity swash plate compressor comprising:

a housing, the housing including a suction port via which a suction refrigerant gas is drawn from an evaporator, a suction chamber, a refrigerant inlet passage communicating between the suction port and the suction chamber, at least one compression chamber for drawing the suction refrigerant from the suction chamber and compressing the suction refrigerant gas into a high-pressure refrigerant gas, a discharge chamber into which the high-pressure refrigerant gas is delivered from the at least one compression chamber, and a crankcase;

at least one piston for each changing a volume of each of the at least one compression chamber;

a swash plate accommodated within the crankcase, for transmitting a driving force to the at least one piston;

a valve element arranged at an intermediate portion of the refrigerant inlet passage, for increasing or decreasing an opening area of the intermediate potion of the refrigerant inlet passage;

an urging member urging the valve element in a direction of a large valve opening position in which the opening area of the intermediate portion is large;

an accumulator for accumulating the high-pressure refrigerant gas therein to build up pressure for urging the valve element in a direction of a small valve opening position in which the opening area of the intermediate portion is small;

a high-pressure passage for permitting the high-pressure refrigerant gas to flow from the discharge chamber into the accumulator;

a pilot valve arranged at an intermediate portion of the high-pressure passage, for closing the high-pressure passage to inhibit supply of the high-pressure refrigerant gas to the accumulator to thereby bring the valve element to the large valve opening position, when suction pressure of the suction refrigerant gas is high, and opening the high-pressure passage to permit supply of the high-pressure refrigerant gas to the accumulator to thereby bring the valve element to the small valve opening position, when the suction pressure of the suction refrigerant gas is low; and a selector valve that operates to select a first valve position for establishing communication between the suction port and the crankcase when the valve element is in the large valve opening position, and a second valve position for establishing communication between the suction chamber and the accumulator when the valve element is in the small valve opening position.

According to this clutchless variable capacity swash plate compressor of the invention, when the suction pressure of the suction refrigerant gas is low, the pilot valve opens to bring the valve element to the small valve opening position, and at the same time the selector valve operates to establish communication between the suction chamber and the accumulator. As a result, the high-pressure refrigerant gas supplied from the high-pressure chamber to the accumulator flows into the suction chamber, whereby the refrigerant gas is circulated within the compressor.

Preferably, the clutchless variable capacity swash plate compressor includes a circulation passage communicating between the suction chamber and the accumulator, the circulation passage being supplied with the high-pressure refrigerant gas, depending on the suction pressure of the suction refrigerant gas, and the selector valve is a spool valve comprising a valve chamber, a spool accommodated within the valve chamber, and a spool-urging member arranged on one side of the spool, for urging the spool in a direction of the first valve position, the valve chamber having a valve chamber portion on another side of the spool, into which the high-pressure refrigerant gas is introduced from the circulation passage to create pressure for urging the spool in a direction of the second valve position.

More preferably, an urging force of the spool-urging member for urging the spool in the direction of the first valve position is smaller than an urging force of the pressure created by the high-pressure refrigerant gas within the valve chamber portion, for urging the spool in the direction of the second valve position.

According to this preferred embodiment, the spool of the spool valve slides when the pressure of the refrigerant gas introduced into the valve chamber portion exceeds the urging force of the urging member, to thereby establish communication between the suction chamber and the accumulator. As a result, the high-pressure refrigerant gas is permitted to flow from the high-pressure chamber to the suction chamber to thereby circulate the refrigerant within the compressor.

Further preferably, the clutchless variable capacity swash plate compressor includes valve means for closing the circulation passage when the suction pressure of the suction refrigerant gas is high, and opening the circulation passage when the suction pressure of the suction refrigerant gas is low.

Preferably, the accumulator has an opening formed in an inner wall of the refrigerant inlet passage, the valve element being fitted in the opening of the accumulator to serve as one of walls defining the accumulator, the urging member being interposed between a suction passage-side end face of the valve element and an inner wall of the suction passage opposed to the suction passage-side end face of the valve element, for urging the valve element in the direction of the large valve opening position in which the valve element is retracted into the accumulator, the valve element being caused to slide in the accumulator between the large valve opening position and the small valve opening position, by a sum of the suction pressure of the suction refrigerant gas, an urging force of the urging member, and the pressure of the high-pressure refrigerant gas supplied to the accumulator depending on the suction pressure of the suction refrigerant gas.

Still more preferably, the circulation passage has an end opening in a side wall of the accumulator, the valve means comprising the side wall of the accumulator and the valve element.

Still further preferably, the circulation passage bifurcates into a first passage for circulating the high-pressure refrigerant gas to the suction chamber and a second passage for introducing the high-pressure refrigerant gas into the valve chamber portion of the spool valve, the first passage being provided with a restriction.

Preferably, the pilot valve comprises a solenoid valve.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 1:
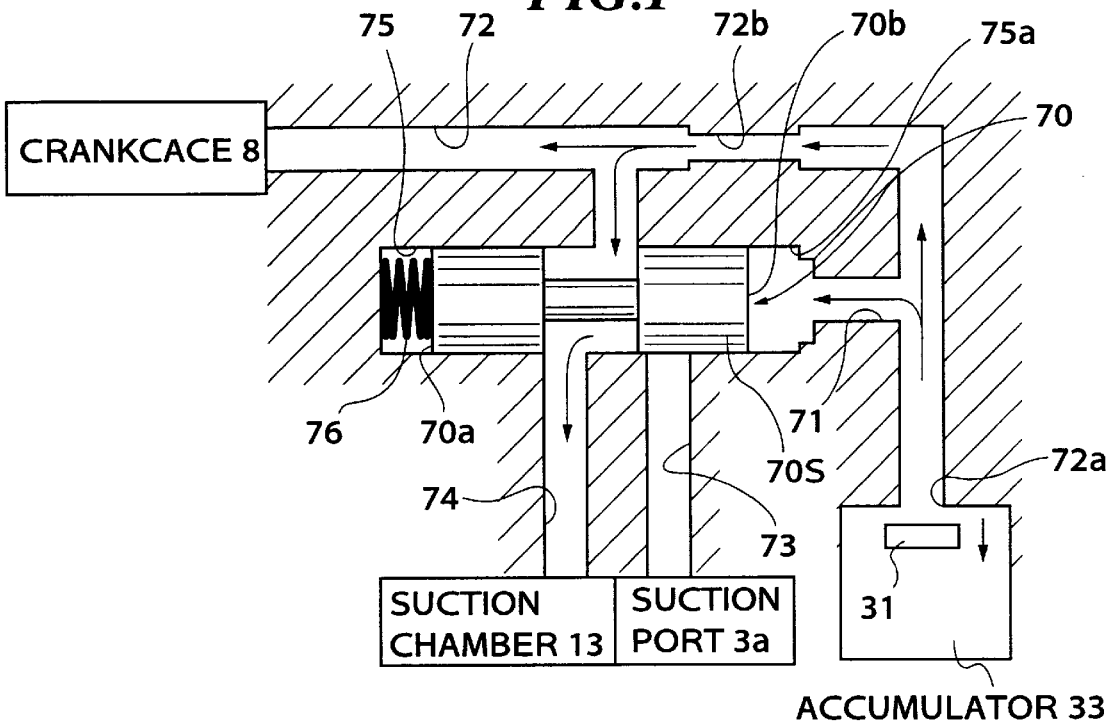
FIG. 1 is a conceptual view of a selector valve in a valve position which is in when a valve element arranged in a refrigerant inlet passage is in a small valve opening position.
Figure 2:
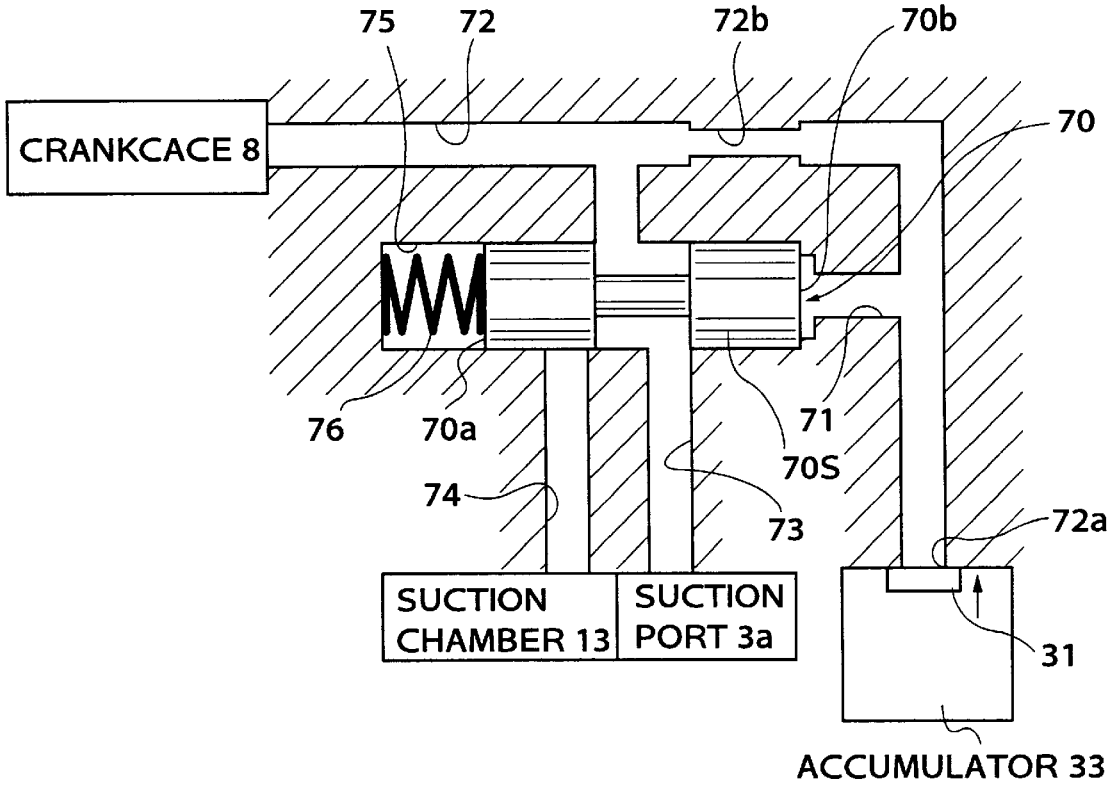
FIG. 2 is a conceptual view of the selector valve in a valve position which is in when the valve element is in a large valve opening position.
Figure 3:
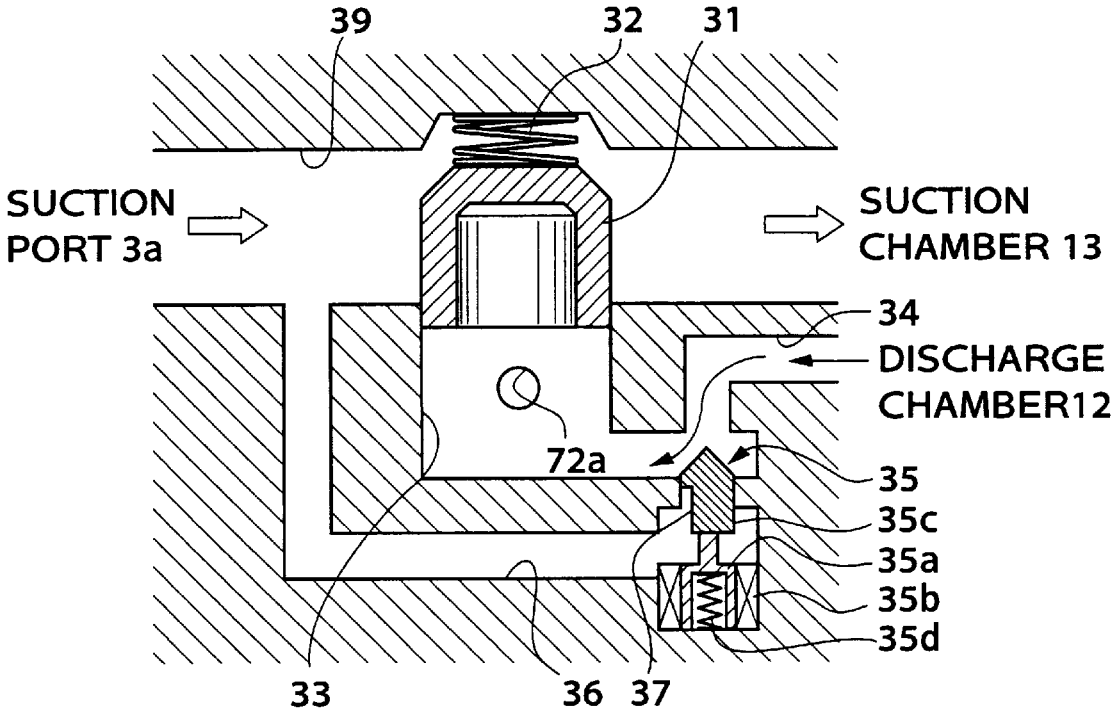
FIG. 3 is a conceptual view showing the valve element in the small valve opening position.
Figure 4:
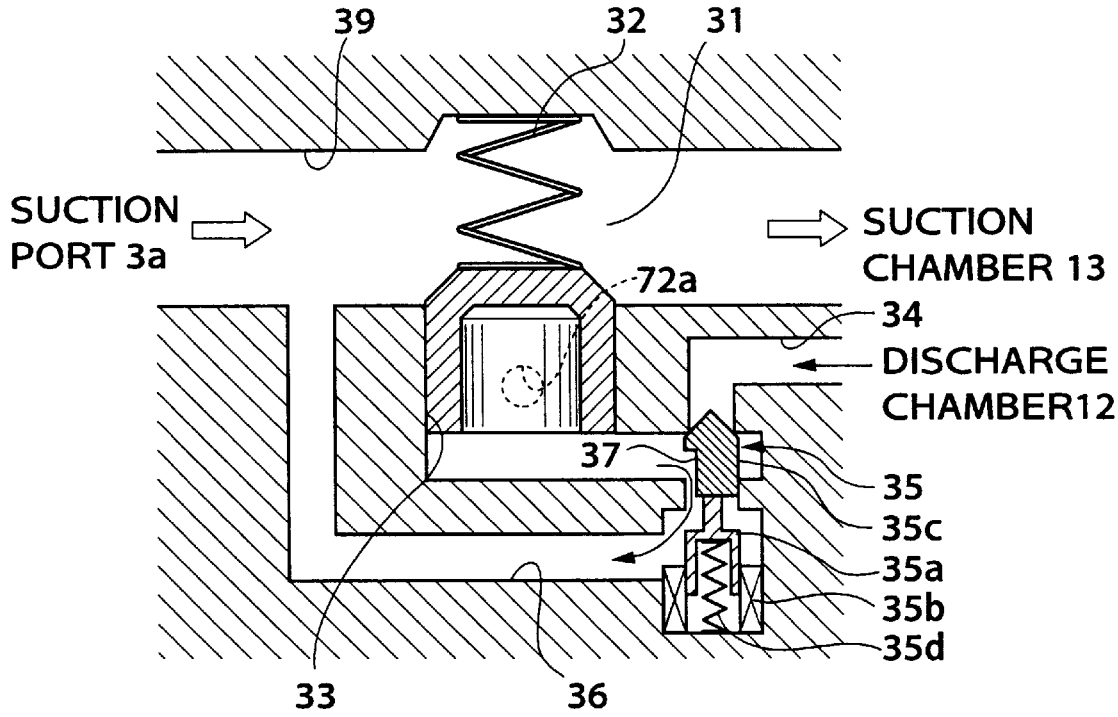
FIG. 4 is a conceptual view showing the valve element in the large valve opening position.
Figure 5:
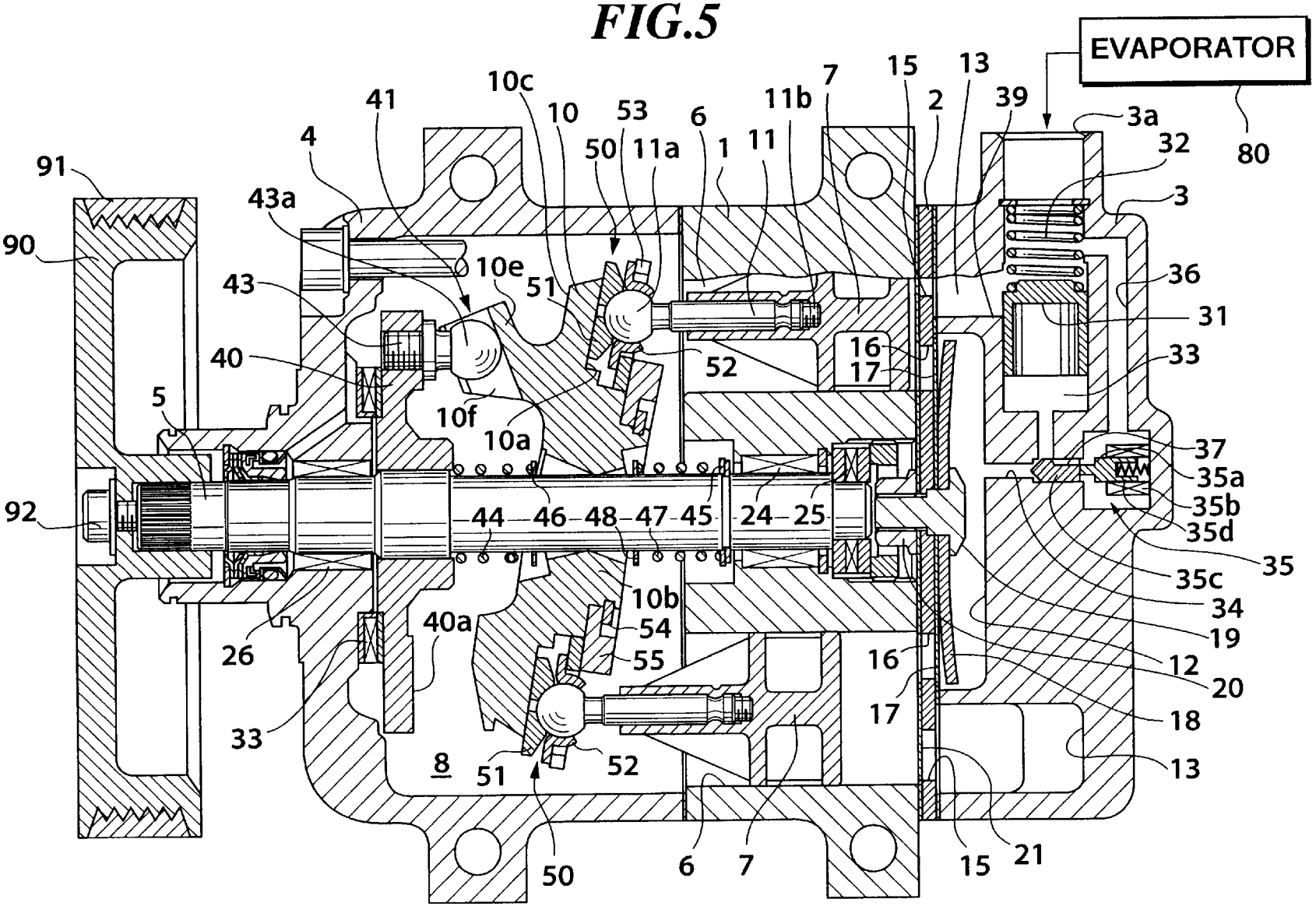
FIG. 5 is a longitudinal sectional view showing the whole arrangement of a clutchless variable capacity swash plate compressor according to an embodiment of the invention.

FIG. 5 shows the whole arrangement of a clutchless variable capacity swash plate compressor according to an embodiment of the invention. FIGS. 1 to 4 are conceptual views which schematically represent the construction of the embodiment and hence are useful in explaining the operation of the FIG. 5 compressor, but do not represent actual design of the compressor. FIG. 1 shows a selector valve in a valve position which is in when a valve element 31, referred to hereinafter, is in a small valve opening position, while FIG. 2 shows the selector valve in a valve position which is in when the valve element is in a large valve opening position. Further, FIG. 3 shows the valve element 31 in the small valve opening position, while FIG. 4 shows the valve element 31 in the large valve opening position.

The clutchless variable capacity awash plate compressor has a cylinder block 1 having one end thereof secured to a rear head 3 via a valve plate 2 and the other end thereof secured to a front head 4. The cylinder block 1 has a plurality of cylinder bores 6 axially extending therethrough at predetermined circumferential intervals about a drive shaft 5. Each cylinder bore 6 has a piston 7 slidably received therein. The cylinder block 1, the rear head 3 and the front head 4 form a housing of the compressor.

The front head 4 defines therein a crankcase 8 in which a swash plate 10 is received for rotation in unison with the drive shaft 5. A retainer 53 retains a plurality of shoes 50 on a sliding surface 10*a* of the swash plate 10. Each connecting rod 11 has one end 11*a*, spherical in shape, slidably connected to a corresponding one of the shoes 50. The retainer 53 is mounted on a boss 10*b* of the swash plate 10 in a manner slidably supported or held by a lock plate 55 rigidly fitted on the boss lob of the swash plate 10. The connecting rod 11 has the other end portion 11*b* thereof secured to a corresponding one of the pistons 7.

Each shoe 50 is comprised of a shoe body 51 for supporting a front surface of the one end 11*a* of the connecting rod 11 such that the one end 11*a* is slidable on the shoe body 51, and a washer 52 for supporting or retaining a rear surface of the one end 11*a* such that the rear surface of the one end 11*a* is slidable on the washer 52.

The rear head 3 defines a discharge chamber 12 and a suction chamber 13 surrounding the discharge chamber 12. Further, the rear head 3 is formed with a suction port 3*a* connected to a refrigerant outlet port of an evaporator 80, and a refrigerant inlet passage 39 (see FIG. 3) communicating between the suction port 3*a* and the suction chamber 13.

As shown in FIGS. 3 and 4, the valve element 31 is arranged at an intermediate portion of the refrigerant inlet passage 39. The valve element 31 is urged by a spring (urging member) 32 in a direction of increasing the valve opening thereof, and urged in a direction of decreasing the valve opening thereof by pressure of refrigerant gas within an accumulator 33.

At an intermediate portion of a passage (high-pressure passage) 34 via which refrigerant gas within the discharge chamber 12 flows into the accumulator 33, there is provided a pilot valve (e.g. a solenoid valve) 35 for controlling a flow rate of the refrigerant gas flowing into the accumulator 33 in dependence on pressure of refrigerant gas drawn into the refrigerant inlet passage 39 via the suction port 3*a* (hereinafter referred to as "the pressure in the suction port 3*a*").

The pilot valve 35 is comprised of a movable rod 35*a*, an electromagnetic coil 35*b* for driving the movable rod 35*a* in dependence on the pressure in the suction port 3*a*, a valve element 35*c* fixed to the movable rod 35*a*, and a spring 35*d* for constantly urging the movable rod 35*a* in a valve-closing direction.

The valve element 35*c* of the pilot valve 35 has an indentation (pressure control passage) 37 formed in a peripheral surface thereof, for permitting refrigerant gas within the accumulator 33 to escape to the suction port 3*a* to thereby reduce pressure in the accumulator 33.

A passage 36 communicates between the suction port 3*a* and the intermediate portion of the passage 34 at which the pilot valve 35 is arranged.

As shown in FIGS. 1 and 2, the crankcase 8 and the accumulator 33 are communicated with each other via a passage 72. The passage 72 has a restriction 72*b* formed at an intermediate portion thereof. The suction port 3*a* communicates with the passage 72 via a passage 73, while the suction chamber 13 communicates with the passage 72 via a passage 74. A valve chamber 75 is formed in a manner connecting between intermediate portions of the two passages 73, 74. The valve chamber 75 slidably accommodates a spool 70*s* to thereby form a spool valve (selector valve) 70.

The spool 70*s* has one end face 70*a* thereof receiving an urging force from a spring 76 and the other end face 70*b* thereof receiving pressure in a valve chamber portion 75*b* which the other end face 70*b* faces and into which high-pressure refrigerant gas is introduced via a passage 71 communicating with the passage 72. When the pressure of the refrigerant gas exceeds the urging force of the spring 76, the spool 70*s* is moved leftward as shown in FIG. 1, for communicating between the accumulator 33 and the suction chamber 13. On the other hand, when the urging force of the spring 76 exceeds the pressure of the refrigerant gas, the spool 70*s* is moved rightward as shown in FIG. 2, for communicating between the suction port 3*a* and the crankcase 8.

The valve plate 2 is formed with refrigerant outlet ports 16 for each communicating between a compression chamber within a corresponding one of the cylinder bores 6 and the discharge chamber 12, and refrigerant inlet ports 15 for each communicating between a compression chamber within a corresponding one of the cylinder bores 6 and the suction chamber 15. The refrigerant outlet ports 16 and the refrigerant inlet ports 15 are arranged at predetermined circumferential intervals about the drive shaft 5. The refrigerant outlet ports 16 are opened and closed by respective discharge valves 17 formed as a unitary member. The unitary member of the discharge valves 17 is fixed to a rear head-side end face of the valve plate 2 by a bolt 19 and a nut 20 together with a valve stopper 18. On the other hand, the refrigerant inlet ports 15 are opened and closed by respective suction valves 21 formed as a unitary member arranged between the valve plate 2 and the cylinder block 1.

A rear end of the drive shaft 5 is rotatably supported by a radial bearing 24 and a thrust bearing 25, while a front end of the drive shaft 5 is rotatably supported by a radial bearing 26. A pulley 90 is fixed to the front end of the drive shaft 5 by a bolt 92, and a belt 91 is passed over the pulley 90.

The drive shaft 5 has a thrust flange 40 rigidly fitted on a front portion thereof for transmitting torque from the drive shaft 5 to the swash plate 10. The thrust flange 40 is rotatably supported on an inner wall of the front head 4 by a thrust bearing 33. The thrust flange 40 and the swash plate 10 are connected with each other via a linkage 41. The swash plate 10 is axially slidably fitted on the drive shaft 5 such that it is tiltable with respect to an imaginary plane perpendicular to the drive shaft 5.

A coiled spring 44 is fitted on the drive shaft 5 between the thrust flange 40 and a stopper 46, while a coiled spring 47 is fitted on the drive shaft 5 between a stopper 45 and a stopper 48.

The linkage 41 is comprised of a bracket 10*e* formed on a front surface 10*c* of the swash plate 10, a linear guide groove 10*f* formed in the bracket 10*e*, and a rod 43 screwed into a swash plate-side surface 40*a* of the thrust flange 40. The longitudinal axis of the guide groove 10*f* is inclined at a predetermined angle with respect to the front surface 10*c* of the swash plate 10. The rod 43 has one spherical end 43*a* thereof slidably fitted in the guide groove 10*f*.

Next, the operation of the clutchless variable capacity swash plate compressor constructed as above will be described.

Torque of an engine, not shown, installed on an automotive vehicle, not shown, is transmitted to the drive shaft 5 to rotate the same. The torque is transmitted from the drive shaft 5 to the swash plate 10 via the thrust flange 40 and the linkage 41 to cause rotation of the swash plate 10.

When the swash plate 10 is rotated, the shoes 50 slide along the sliding surface 10*a* of the swash plate 10. Because of the angle that the swash plate 10 forms with the imaginary plane perpendicular to the drive shaft 5, the torque transmitted from the swash plate 10 is converted into the reciprocating motion of each piston 7. As the piston 7 reciprocates within the cylinder bore 6 associated therewith, the volume of a compression chamber within the cylinder bore 6 changes. As a result, suction, compression and delivery of refrigerant gas are sequentially carried out in the compression chamber, whereby high-pressure refrigerant gas is delivered from the compression chamber in an amount corresponding to the inclination of the swash plate 10. During the suction stroke, the suction valve 21 opens to draw low-pressure refrigerant gas from the suction chamber 13 into the compression chamber within the cylinder bore 6. During the discharge stroke of the corresponding piston 7, the discharge valve 17 opens to deliver high-pressure refrigerant gas from the compression chamber to the discharge chamber 12.

When thermal load on the compressor decreases, the pressure in the suction port 3*a* is lowered, and hence the force urging the valve element 31 in a depressing direction (in a direction of a large valve opening position) is reduced. At the same time, the electromagnetic coil 35*b* of the pilot valve 35 is energized to magnetically attract the movable rod 35*a* against the urging force of the spring 35*d*. As a result, the valve element 35*c* of the pilot valve 35 is opened, whereby high-pressure refrigerant gas within the discharge chamber 12 flows into the accumulator 33 via the passage 34. The pressure in the accumulator 33 increases at a fast rate, so that the valve element 31 is lifted up instantaneously to decrease the valve opening thereof (opening area of the portion of the refrigerant inlet passage 39 at which the valve element 31 is arranged). As a result, passage resistance (resistance to a flow of refrigerant within the passage 39) increases, and the pressure in the suction chamber 13 becomes lower than the pressure in the suction port 3*a*, whereby pressure in the refrigerant inlet port 15 continuous with the suction chamber 13 and the compression chamber communicated with the suction chamber 13 via the refrigerant inlet port 15 is decreased. The sum of forces acting on the rear faces of the pistons 7 becomes larger than the sum of forces acting on the front faces of the same, so that the angle of inclination of the swash plate 10 decreases. As a result, the length of stroke of the piston 7 is decreased to reduce the delivery quantity or capacity of the compressor.

Further, when the valve element 31 is brought to the small valve opening position, the opening 72*a* of the passage 72 is opened to the accumulator 33 (see FIG. 3). As a result, the high-pressure refrigerant flows into the valve chamber portion 75*b* via the passages 72 and 71 from the accumulator 33 so that the pressure of the high-pressure refrigerant gas acts on the other end face 70*b* of the spool 70*s*. Since the pressure of refrigerant gas acting on the other end face 70*b* of the spool 70*s* is larger in force than the urging force acting on the one end face 70*a* of the same, the spool 70*s* is caused to slide leftward as shown in FIG. 1, whereby the discharge chamber 12 communicates with the suction chamber 13 via the accumulator 33 to permit high-pressure refrigerant gas within the discharge chamber 12 to flow into the suction chamber 13. Thus, the refrigerant gas delivered to the suction chamber 13 is circulated within the compressor. It should be noted that although the supply of the high-pressure refrigerant gas to the suction chamber 3 increases the pressure within the suction chamber 3, since the delivery quantity or capacity is small and the restriction 72*b* permits the high-pressure refrigerant to be supplied at a small flow rate dependent on the pressure within the accumulator 33 urging the valve element 31 in the valve-closing direction, this increase in the pressure within the suction chamber 13 does not cancel the decrease in the pressure within the suction chamber 13 caused by closing of the valving element 31. As a result, the angle of inclination of the swash plate 10 remains the minimum and the refrigerant circulates through the compressor in the minimum delivery quantity.

When the valve element 31 is closed, the pressure in the discharge chamber 12 is reduced, so that a check valve, not shown, of a discharge port, not shown, of the compressor, is not opened.

On the other hand, when the thermal load on the compressor increases, the pressure in the suction port 3*a* rises to increase the force urging the valve element 31 in the depressing direction. At the same time, the electromagnetic coil 35*b* of the pilot valve 35 is deenergized, and the movable rod 35*a* is moved by the urging force of the spring 35*d* to close the valve element 35*c* of the pilot valve 35, as shown in FIG. 4, whereby the flow of high-pressure refrigerant gas into the accumulator 33 is interrupted. At this time point, the accumulator 33 communicates with the passage 36 via the indentation 37 formed in the peripheral surface of the pilot valve 35, so that refrigerant gas escapes from the accumulator 33 to the suction port 3*a* via the indentation 37 and the passage 36. As a result, the pressure in the accumulator 33 is decreased, whereby the valve element 31 is lowered instantaneously to increase the valve opening thereof, and the pressure in the suction chamber 13 becomes equal to that in the suction port 3*a*. In this state, the sum of the forces acting on the rear faces of the pistons 7 during each compression stroke does not increase to so high a level as it does under the low-load condition of the compressor. Therefore, the sum of the forces acting on the rear faces of the pistons 7 becomes smaller than the sum of the forces acting on the front faces of the same, whereby the inclination of the swash plate 10 is increased. As a result, the length of stroke of the piston 7 is increased to increase the delivery quantity or capacity of the compressor.

Further, when the valve element 31 is in the large valve opening position, the opening 72*a* of the passage 72 os closed by the valve element 31 (see FIG. 4). In this state, since the opening 72*a* is closed by the valve element 31 to inhibit the supply of the high-pressure refrigerant gas to the passages 72 and 71 the pressure of refrigerant gas acting on the other end face 70*b* of spool 70*s* becomes smaller than the urging force of the spring 76 acting on the one end face 70*a* of the same, so that the spool 70*s* is caused to slide rightward as shown in FIG. 2, whereby the suction port 3*a* communicates with the crankcase 8.

According to the clutchless variable capacity swash plate compressor of the embodiment, the compressor does not employ a sleeve axially slidable on the drive shaft 5, but the radial bearing 24 is directly mounted on the drive shaft 5, so that it is possible to preload the drive shaft 5 sufficiently and at the same time decrease a radial gap between the bearing 24 and the cylinder block 1, to thereby prevent generation of untoward noises.

Further, since the cylinder block 1 and other components are not complicated in construction, it is possible to share component parts with clutch-type variable capacity swash plate compressors.

Although in the above embodiment, the spool valve 70 is employed as the selector valve, this is not limitative, but other types of valves such as a rotary valve may be used.

Further, although in the above embodiment, a solenoid valve is employed as the pilot valve 35, this is not limitative, either, but other types of valves such as a bellows valve may be used.

It is further understood by those skilled in the art that the foregoing is the preferred embodiment and variations of the invention, and that various changes and modifications may be made without departing from the spirit and scope thereof.

What is claimed is:

1. A clutchless variable capacity swash plate compressor comprising:

a housing, said housing including a suction port via which a suction refrigerant gas is drawn from an evaporator, a suction chamber, a refrigerant inlet passage communicating between said suction port and said suction chamber, at least one compression chamber for drawing said suction refrigerant from said suction chamber and compressing said suction refrigerant gas into a high-pressure refrigerant gas, a discharge chamber into which said high-pressure refrigerant is delivered from said at least one compression chamber, and a crankcase;

a piston within each said at least one compression chamber for changing a volume of each of said at least one compression chamber;

a swash plate accommodated within said crankcase, for transmitting a driving force to said at least one piston;

a valve element arranged at an intermediate portion of said refrigerant inlet passage, for increasing or decreasing an opening area of said intermediate portion of said refrigerant inlet passage;

an urging member urging said valve element in a direction of a large valve opening position in which said opening area of said intermediate portion is large;

an accumulator for accumulating said high-pressure refrigerant gas therein to build up pressure for urging said valve element in a direction of a small valve opening position in which said opening area of said intermediate portion is small;

a high-pressure passage for permitting said high-pressure refrigerant gas to flow from said discharge chamber into said accumulator;

a pilot valve arranged at an intermediate portion of said high-pressure passage, for closing said high-pressure passage to inhibit supply of said high-pressure refrigerant gas to said accumulator to thereby bring said valve element to said large valve opening position, when suction pressure of said suction refrigerant gas is high, and opening said high-pressure passage to permit supply of said high-pressure refrigerant gas to said accumulator to thereby bring said valve element to said small valve opening position, when said suction pressure of said suction refrigerant gas is low; and a selector valve that operates to select a first valve position for establishing communication between said suction port and said crankcase when said valve element is in said large valve opening position, and a second valve position for establishing communication between said suction chamber and said accumulator when said valve element is in said small valve opening position.

2. A clutchless variable capacity swash plate compressor according to claim 1, including a circulation passage communicating between said suction chamber and said accumulator, said circulation passage being supplied with said high-pressure refrigerant gas, depending on said suction pressure of said suction refrigerant gas, wherein said selector valve is a spool valve comprising a valve chamber, a spool accommodated within said valve chamber, and a spool-urging member arranged on one side of said spool, for urging said spool in a direction of said first valve position, said valve chamber having a valve chamber portion on another side of said spool, into which said high-pressure refrigerant gas is introduced from said circulation passage to create pressure for urging said spool in a direction of said second valve position.

3. A clutchless variable capacity swash plate compressor according to claim 2, wherein an urging force of said spool-urging member for urging said spool in said direction of said first valve position is smaller than an urging force of said pressure created by said high-pressure refrigerant gas within said valve chamber portion, for urging said spool in said direction of said second valve position.

4. A clutchless variable capacity swash plate compressor according to claim 3, including valve means for closing said circulation passage when said suction pressure of said suction refrigerant gas is high, and opening said circulation passage when said suction pressure of said suction refrigerant gas is low.

5. A clutchless variable capacity swash plate compressor according to claim 1, wherein said accumulator has an opening formed in an inner wall of said refrigerant inlet passage, said valve element being fitted in said opening of said accumulator to serve as one of walls defining said accumulator, said urging member being interposed between a suction passage-side end face of said valve element and an inner wall of said suction passage opposed to said suction passage-side end face of said valve element, for urging said valve element in said direction of said large valve opening position in which said valve element is retracted into said accumulator, said valve element being caused to slide in said accumulator between said large valve opening position and said small valve opening position, by a sum of said suction pressure of said suction refrigerant gas, an urging force of said urging member, and said pressure of said high-pressure refrigerant gas supplied to said accumulator depending on said suction pressure of said suction refrigerant gas.

6. A clutchless variable capacity swash plate compressor according to claim 2, wherein said accumulator has an opening formed in an inner wall of said refrigerant inlet passage, said valve element being fitted in said opening of said chamber of said accumulator to serve as one of walls defining said accumulator, said urging member being interposed between a suction passage-side end face of said valve body and an inner wall of said suction passage opposed to said suction passage-side end face of said valve element, for urging said valve element in said direction of said large valve opening position in which said valve element is retracted into said accumulator, said valve element being caused to slide in said accumulator between said large valve opening position and said small valve opening position, by a sum of said suction pressure of said suction refrigerant gas, an urging force of said urging member, and said pressure of said high-pressure refrigerant gas supplied to said accumulator depending on said suction pressure of said suction refrigerant gas.

7. A clutchless variable capacity swash plate compressor according to claim 4, wherein said accumulator has an opening formed in an inner wall of said refrigerant inlet passage, said valve element being fitted in said opening of said chamber of said accumulator to serve as one of walls defining said accumulator, said urging member being interposed between a suction passage-side end face of said valve body and an inner wall of said suction passage opposed to said suction passage-side end face of said valve element, for urging said valve element in said direction of said large valve opening position in which said valve element is retracted into said accumulator, said valve element being caused to slide in said accumulator between said large valve opening position and said small valve opening position, by a sum of said suction pressure of said suction refrigerant gas, an urging force of said urging member, and said pressure of said high-pressure refrigerant gas supplied to said accumulator depending on said suction pressure of said suction refrigerant gas.

8. A clutchless variable capacity swash plate compressor according to claim 4, wherein said circulation passage has an end opening in a side wall of said accumulator, said valve means comprising said side wall of said accumulator and said valve element.

9. A clutchless variable capacity swash plate compressor according to claim 5, wherein said circulation passage has an end opening into a side wall of said accumulator, said valve means comprising said side wall of said accumulator and said valve element.

10. A clutchless variable capacity swash plate compressor according to claim 7, wherein said circulation passage bifurcates into a first passage for circulating said high-pressure refrigerant gas to said suction chamber and a second passage for introducing said high-pressure refrigerant gas into said valve chamber portion of said spool valve, said first passage being provided with a restriction.

11. A clutchless variable capacity swash plate compressor according to claim 1, wherein said pilot valve comprises a solenoid valve.

* * * * *